US006536145B2

(12) United States Patent
Burtch et al.

(10) Patent No.: US 6,536,145 B2
(45) Date of Patent: Mar. 25, 2003

(54) ERECTABLE DISPLAY DEVICE WITH REVEALABLE INNER PANEL

(76) Inventors: Ronald P. Burtch, 4543 Aurora Rd. RR 3, Stouffville, Ontario (CA), L4A 7X4; Irving M. Koltz, 3 Youngmill Drive, East York, Ontario (CA), M4B 2W5

( * ) Notice: Subject to any disclaimer, the term of this patent is extended or adjusted under 35 U.S.C. 154(b) by 183 days.

(21) Appl. No.: 09/737,469

(22) Filed: Dec. 18, 2000

(65) Prior Publication Data

US 2002/0073583 A1 Jun. 20, 2002

(51) Int. Cl.[7] ..... G09F 1/00

(52) U.S. Cl. ..... 40/124.08; 40/124.14; 40/124.16

(58) Field of Search ..... 40/124.14, 124.08, 40/124.16; 446/147

(56) References Cited

U.S. PATENT DOCUMENTS 2,142,826 A * 1/1939 Rosello
2,833,074 A * 5/1958 Jannes
3,624,939 A * 12/1971 Gossard
5,259,133 A 11/1993 Burtch
5,450,680 A * 9/1995 Bromberg
5,479,732 A 1/1996 Burtch et al.
5,608,977 A 3/1997 Burtch et al.
5,613,311 A 3/1997 Burtch
5,732,491 A 3/1998 Burtch

* cited by examiner

*Primary Examiner*—D. Glenn Dayoan
*Assistant Examiner*—Scott Carpenter
(74) *Attorney, Agent, or Firm*—Larson & Taylor, PLC

(57) ABSTRACT

A display device is provided which is formed by first and second outer panels and a third, inner panel disposed between the outer panels. The outer panels are joined together separately from the inner panel in a first portion of the device and each of the outer panels includes a slit in this first portion and fold lines therein for enabling the joined outer panels to be pulled apart and separated along the slit to expose the inner panel for display. All of the panels are joined together at a further, base portion of the device. The fold lines in outer panels provide folding of parts of the outer panels forming the base portion of the device into a support arrangement for the device. In a first state of the device, the inner panel is shielded from view by the outer panels and the inner and outer panels form a unit of a substantially flat, planar configuration, and, in a second state of the device, the inner panel is exposed for display and is supported by the support arrangement. A retaining notch arrangement retains the device in the second state.

20 Claims, 3 Drawing Sheets

ERECTABLE DISPLAY DEVICE WITH REVEALABLE INNER PANEL

BACKGROUND OF THE INVENTION

1. Field of the Invention

The present invention relates to display devices including inexpensive novelty items used for promotional purposes and/or as items to be collected in sets, and more particularly, to an erectable display device of a special construction which enables the device to be easily manipulated to reveal a hidden panel for display.

2. Background of the Invention

In an earlier patent, U.S. Pat. No. 5,259,133, there is described a "pop-up" display device in the nature of a baseball card or the like. The device includes an erectable pop-up display portion that is erectable from a planar configuration, wherein the device resembles a baseball card or the like, to a display configuration or state wherein an action figure such as a baseball figure "pops up" from the baseball "card" and is displayed. A somewhat similar display device is described in U.S. Pat. Nos. 5,479,732, 5,608,977, 5,613,311 and 5,732,491. In these patents, the "periscoping" action of a display portion or panel enables erecting of the device from a planar configuration or state to a display configuration or state wherein the display portion is displayed. As discussed in more detail in the patents themselves, the devices disclosed in these patents provide added interest as compared with conventional sports cards because of the pop-up or periscoping display features thereof.

BRIEF SUMMARY OF THE INVENTION

According to the invention, an erectable display device is provided which is quite inexpensive to make and which can be easily and readily manipulated from a planar configuration or state into a display configuration or state wherein a display portion or panel is revealed and the device can be made to stand up on a support surface. Although the device is clearly not limited to such applications, one important application is in the field of sports cards, wherein, for example, the device, in the planar state thereof, depicts a ball used in a particular sport or athletic event and, in the erected, display configuration or state, reveals or exposes a previously hidden panel or portion depicting a player of that sport. The display device of the invention, which is preferably made of heavy paper, cardboard, paperboard or the like, is simple in construction and is easy to assembly. In the latter regard, in a preferred embodiment, the device is preferably assembled from a single piece blank which is configured in accordance with a further aspect of the invention. In addition, the device includes a support arrangement which permits the device to be supported on a flat surface in the display configuration thereof as well as releasable means for retaining the device in this display configuration.

In accordance with one aspect of the invention, a display device is provided which comprises first and second outer panels and a third, inner panel disposed between said first and second outer panels, said outer panels being joined together separately from said inner panel in a first portion of the device and each of the outer panels including a slit in said first portion and fold lines therein for enabling the joined outer panels to be pulled apart and separated along said slit to expose the inner panel for display.

Preferably, the first, second and third panels are joined together at a further, base portion of the device and the old lines in outer panels provide folding of parts of the outer panels forming said base portion of the device into a support arrangement for the device.

Advantageously, in a first state of the device, the inner panel is shielded from view by the outer panels and the inner and outer panels are of a substantially flat configuration, and, in a second state of the device, the inner panel is exposed for display.

The device preferably includes retaining means for retaining the device in the second state thereof wherein the inner panel is exposed for display.

Advantageously, the retaining means comprises at least one notch formed in an edge of one of (i) the inner panels and (ii) the joined outer panels. The at least one notch preferably comprises a pair of notches formed in opposite lateral edges of said inner panel.

Preferably, the joined outer panels define a plane in the first portion of the device and the support arrangement comprises at least one support member extending outwardly of said plane on opposite sides of the device.

More preferably, the joined outer panels define a plane in the first portion of said device and the support arrangement includes first and second support members extending outwardly from said plane on opposite sides thereof. In a preferred embodiment, the slit in each of said outer panels extends from a peripheral edge of the respective panel to a point at least close to a defining part of said first portion and the fold lines include, formed in each of the outer panels, a plurality of fold lines extending laterally outwardly from said point to opposed lateral edges of the corresponding outer panel. Preferably, the laterally extending fold lines of each of the outer panels comprise first and second fold lines extending laterally outwardly on each side of said point and intersecting spaced points on the opposite edges of the device. Advantageously, the fold lines further include, formed in each of the outer panels, two further fold lines extending from said point to an edge of the respective outer panels defining a bottom edge of the device. The two further fold lines preferably form equal legs of an isosceles triangle formed with a part of the respective bottom edge.

Preferably, a portion of said outer panels has a shape of a ball used in a sport and the inner panel includes a depiction of a player of the sport.

Advantageously, the first portion of the device is rounded and the base portion thereof depicts a base for the rounded portion.

Advantageously, the panels are joined together from a single piece blank. Preferably, the outer panels are further joined together along a further fold line at said first portion of the device.

In accordance with a further aspect of the invention, a blank is provided which is adapted for assembly into a display device, the blank comprising first, second and third panels joined together end to end along respective fold lines, two of the panels being substantially identical and having corresponding first and second ends, and including a central longitudinal slit beginning at said first end and terminating at a point spaced from said second end, each of the two panels further comprising a plurality of fold lines therein extending outwardly from said point for providing folding of a portion of the outer panels adjacent to the second end into a support arrangement for the display device when the blank is assembled into the display device.

Advantageously, the other panel of the first, second and third panels includes at least one notch therein for retaining the assembled display device in an assembled state.

Preferably, the fold lines for each of said two panels include first and second sets of oppositely extending fold lines extending outwardly from said point in opposite directions so as to intersect opposite sides of the two panels and first and second further fold lines extending from said point to an edge of said second end.

Preferably, the first ends of said two panels are of a shape of a ball used in a sport and the remaining panel includes a depiction of a player of the sport.

Further features and advantages of the present invention will be set forth in, or apparent from, the detailed description of preferred embodiments thereof which follows.

DETAILED DESCRIPTION OF THE INVENTION

Figure 1:
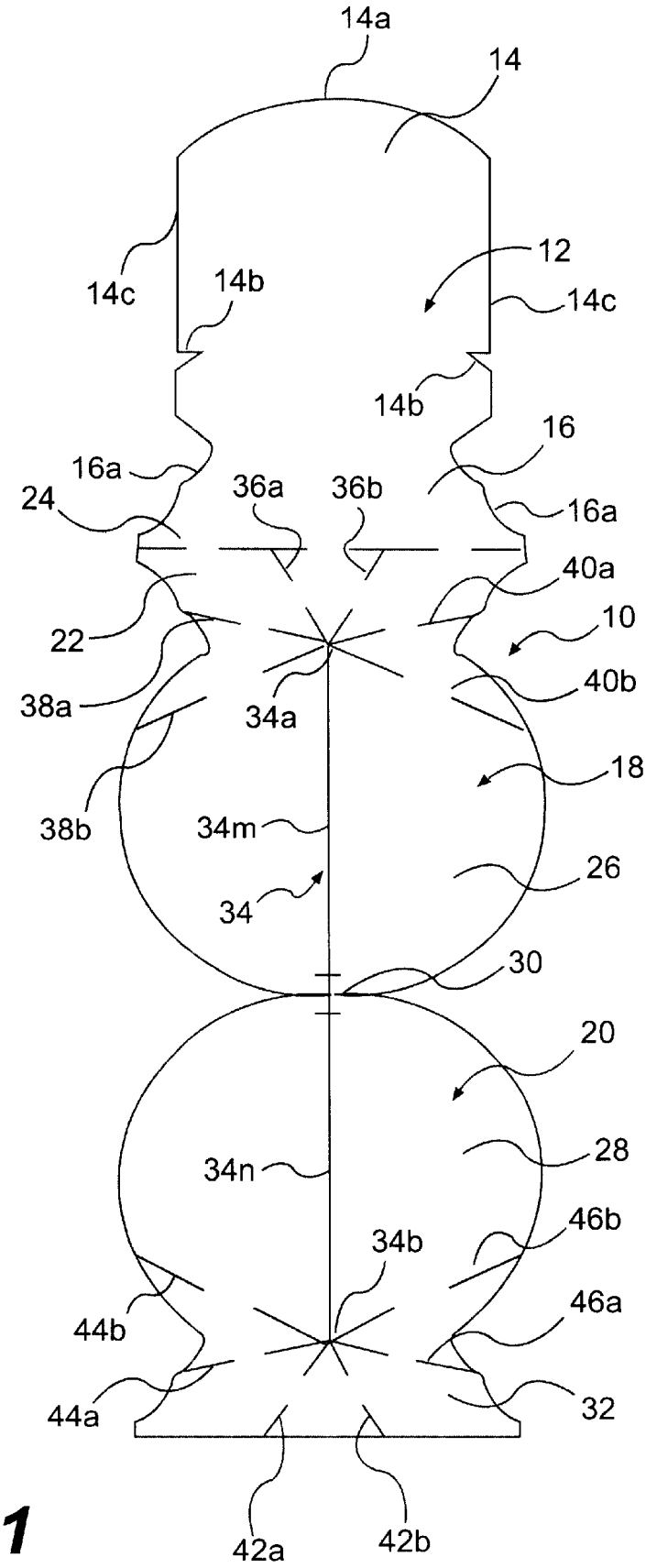
FIG. 1 is a top plan view of a blank configured in accordance with a preferred embodiment of the invention and used in making a display device in accordance with a preferred embodiment of the invention.

Referring to FIG. 1, there is shown a blank, generally denoted 10, from which the device of the invention is made. The blank 10 is designed to be made of inexpensive materials such as paper, cardboard, paperboard or the like, although other suitable materials can, of course, be used. The blank 10 includes a first panel 12 of an elongate shape including a display portion 14 and base portion 16. The display portion includes a rounded distal edge 14*a* and a pair of notches 14*b* in the straight side edges 14*c* thereof. In this embodiment, the base portion 16 includes lateral edges 16*a* which are shaped at the sides to match the shape of the panels described below which represent a "stand" or support for a ball used in an athletic event such as a soccer ball. It will be appreciated that other shapes can be employed and that the shape of display portion 14 can also vary from that depicted.

Blank 10 further includes second and third panels 18 and 20 which are of an identical configuration and which are joined head to head. More specifically, panel 18 includes a base portion 22 which is joined to panel 12 and separated therefrom by a fold line 24 and a rounded display portion 26, while panel 20 similarly includes a rounded display portion 28 joined to display portion 26 of panel 18 along a short fold line 30 and a distal base portion 32 having a profile or outline which matches that of base portion 22 of panel 18 and base portion 16 of panel 12.

A cut line 34, i.e., a line that fully penetrates through the thickness of blank 10 and completely separates opposing parts defined thereby, is formed in panels 18 and 20. Cut line 34 extends orthogonally to fold line 30 and terminates at points at opposite ends thereof which are denoted 34*a* and 34*b* and which are located generally at the beginning area or portion of the respective base portions 22 and 32 of panels 18 and 20. Cut line 34 is continuous and includes respective halves 34*m* and 34*n* located in associated panels 18 and 20.

Considering panel 18 as typical, radiating outwardly from point 34*a* are a series of fold lines 36*a* and 36*b*, 38*a* and 38*b* and 40*a* and 40*b*. Fold lines 36*a* and 36*b* extend between point 34*a* and fold line 24 and, as illustrated, form an approximately equilateral triangle therewith, although, again, the length of the leg formed by fold line 24 need not necessarily equal those formed by fold lines 35*a* and 36*b*. As illustrated, lines 38*a*, 38*b* and 40*a*, 40*b* are similar and extend from point 34*a* to the opposite sides of panel 18. In particular, fold lines 38*a* and 40*a* extend from point 34*a* to opposite sides of the panel 18 so as to intersect the respective sides at a point in the area of base portion 22 close to display portion 26 and fold lines 38*b* and 40*b* extend from point 34*a* to opposite sides of the panel 18 so as to intersect the respective sides at a point in an area of the display portion 26 close to base portion 22.

As indicated above, panel 20 is substantially identical to panel 18 and includes corresponding fold lines 42*a* and 42*b*, 44*a* and 44*b*, and 46*a* and 46*b*. Because panels 18 and 20 are substantially identical the fold lines of panel 20 will not be described further.

Figure 3:
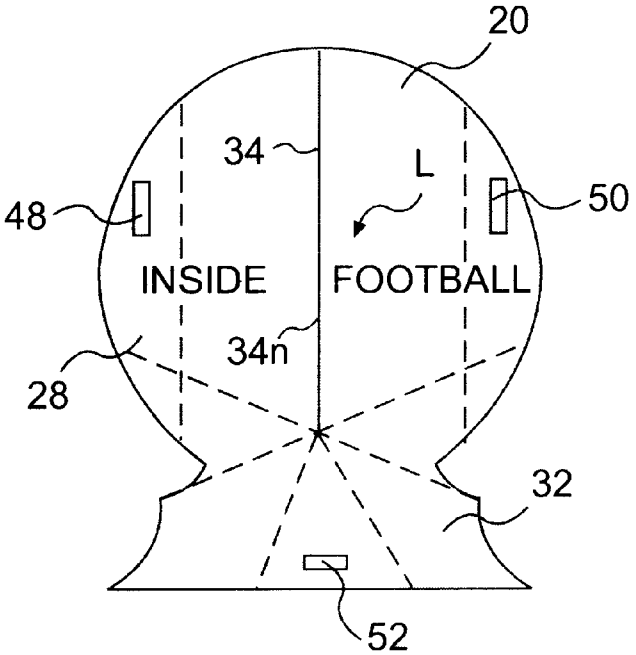
FIG. 3 is a front elevational view of the device in its assembled, planar configuration or state.
Figure 2:
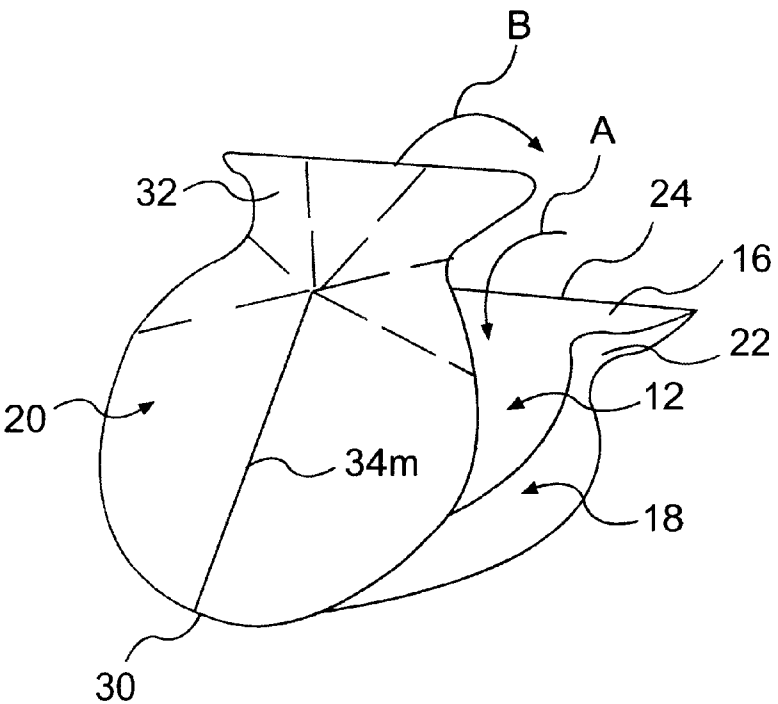
FIG. 2 is a simplified perspective view showing an intermediate step in the assembly of the device of FIG. 1.

Turning now to the manner of assembly of blank, as shown in FIG. 2, panel 12 is folded within panels 18 and 20. In particular, in the example illustrated, and as indicated by arrow A, panel 12 is folded over on top of adjacent panel 18 and, as indicated by arrow B, distal panel 20 is folded over onto panel 12. The resultant assembly is shown in FIG. 3. As illustrated in that figure, the display portions 26 and 28 of substantially identical panels 18 and 20 are joined together with the display 14 of panel 12 therebetween, and are joined at, for example, areas indicated at 48 and 50, by gluing, stapling or any other suitable manner of affixing or attachment. In addition, the substantial identical base portions 16, 22 and 32 of the three panels 12, 18 and 20 are also joined together at, for example, the area indicated at 52 and within the base triangle formed by the respective fold lines, by suitable means such as glue or a like adhesive, stapling or other suitable affixing or attachment means. This produces the finished display device.

As illustrated, the device preferably includes lettering, denoted L ("INSIDE FOOTBALL" in the example shown), and the outwardly facing portion which, in this example, is the display portion 28 and base portion 32 of panel 20, is preferably printed or otherwise provided with a depiction of a soccer ball mounted on a base. Of course, a indicated above, different shapes and different exemplary illustrations can be used, including American footballs, baseballs, tennis balls and the like. It will also be appreciated that although the invention is particularly well adapted to a sports theme, it is obviously not limited to this application.

Figure 5:
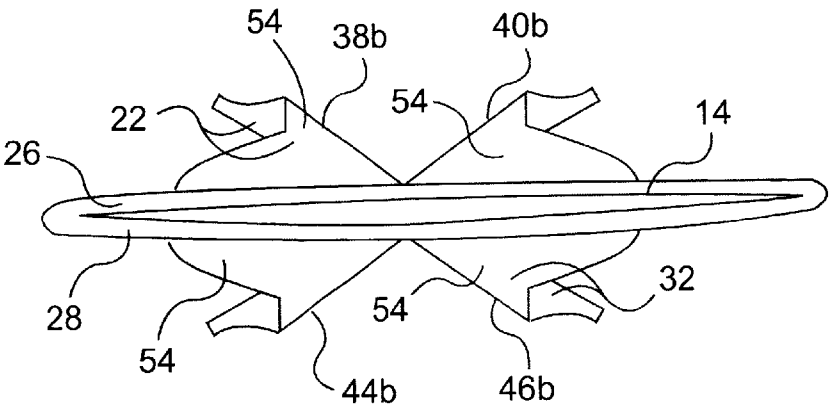
FIG. 5 is a top plan view of the device of FIG. 4.
Figure 4:
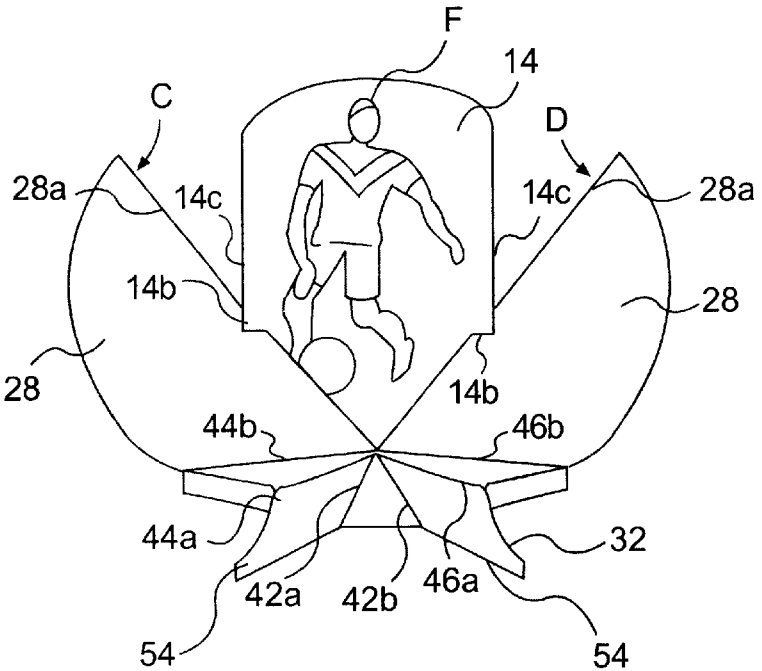
FIG. 4 is a front elevational view of the device after manipulation thereof into the display configuration or state thereof.

Referring to FIGS. 4 and 5, the display state of the device of the invention is shown. It will be appreciated that the assembled device of FIG. 3 is a multi-layer essentially flat or planar item. As shown in FIG. 4, the display portion 14 of the inner panel 12, which is hidden from view in the state of the device shown in FIG. 3, can be exposed for display by pulling apart respective halves of the joined display portions 26 and 28 apart along cut line or slit 34, as indicated by arrows C and D. These half portions of display portions 26 and 28 are pulled apart to a point wherein respective parts of the exposed side edges 28*a* of display portion 28, and the corresponding exposed side edges of joined display portion 26 can be inserted into corresponding notches 14*b* of the display portion 14 of inner panel 12. These notches 14*b* hold or retain the device in the open or display state shown in FIGS. 4 and 5. This separating action also results in the formation of a stand or support base for the device. In this regard, the device folds on fold lines 36*a* and 36*b* and 42*a*, 42*b*, lines 38*a*, 40*a* and 44*a*, 45*a* and lines 38*a*, 40*a* and 44*b*,

46*b* so as to form four separate support legs generally denoted 54 and located on opposite sides of base portion 16 of inner display panel 12. These four support legs 54 of the device serve to support the remainder of the device above a support surface on which the device is placed. The device may be returned to the flattened state thereof by releasing the respective halves of the rounded joined display portions 26 and 28 from the notches 14*b*.

Although the invention has been described above in relation to preferred embodiments thereof, it will be understood by those skilled in the art that variations and modifications can be effected in these preferred embodiments without departing from the scope and spirit of the invention.

What is claimed is:

1. A display device comprising first and second outer panels and a third, inner panel disposed between said first and second outer panels, said outer panels being joined together separately from said inner panel in a first portion of the device and each of the outer panels including a slit in said first portion and fold lines therein for enabling the joined outer panels to be pulled apart and separated along said slit to expose the inner panel for display.

2. A display device according to claim 1 wherein said first, second and third panels are joined together at a further, base portion of said device and wherein said fold lines in outer panels provide folding of parts of said outer panels forming said base portion of the device into a support arrangement for the device.

3. A display device according to claim 1 wherein, in a first state of the device, the inner panel is shielded from view by the outer panels and the inner and outer panels are of a substantially flat configuration and wherein, in a second state of the device, said inner panel is exposed for display.

4. A display device according to claim 3 wherein said device includes retaining means for retaining said device in said second state wherein said inner panel is exposed for display.

5. A display device according to claim 4 wherein said retaining means comprises at least one notch formed in an edge of one of (i) the inner panels and (ii) the joined outer panels.

6. A display device according to claim 5 wherein said at least one notch comprises a pair of notches formed in opposite lateral edges of said inner panel.

7. A display device according to claim 2 wherein said joined outer panels define a plane in said first portion of the device and wherein said support arrangement comprises at least one support member extending outwardly of said plane on opposite sides of the device.

8. A display device according to claim 2 wherein said joined outer panels define a plane in said first portion of said device and wherein said support arrangement includes first and second support members extending outwardly from said plane on opposite sides thereof.

9. A display device according to claim 8 wherein the slit in each of said outer panels extends from a peripheral edge of the respective panel to a point at least close to a defining part of said first portion and wherein said fold lines include, formed in each of said outer panels, a plurality of fold lines extending laterally outwardly from said point to opposed lateral edges of the corresponding outer panels.

10. A display device according to claim 9 wherein the laterally extending fold lines of each of said outer panels comprise first and second fold lines extending laterally outwardly on each side of said point and intersecting spaced points on the opposite edges of said device.

11. A display device according to claim 10 wherein said fold lines further include, formed in each of said outer panels, two further fold lines extending from said point to an edge of the respective outer panels defining a bottom edge of said device.

12. A display device according to claim 11 wherein said two further fold lines form equal legs of an isosceles triangle formed with a part of the respective bottom edge.

13. A display device according to claim 1 wherein a portion of said outer panels has a shape of a ball used in a sport and said inner panel includes a depiction of a player of the sport.

14. A display device according to claim 2 wherein said first portion of the device is rounded and said base portion depicts a base for said rounded portion.

15. A display device according to claim 1 wherein said panels are joined together from a single piece blank.

16. A display device according to claim 15 wherein said outer panels are further joined together along a further fold line at said first portion of the device.

17. A blank for assembly into a display device, said blank comprising first, second and third panels joined together end to end along respective fold lines, two of said panels being substantially identical and having corresponding first and second ends, and including a central longitudinal slit beginning at said first end and terminating at a point spaced from said second end, each of said two panels further comprising a plurality of fold lines therein extending outwardly from said point for providing folding of a portion of said two panels adjacent to said second end into a support arrangement for the display device when said blank is assembled into the display device.

18. A blank according to claim 17 wherein the other panel of said first, second and third panels includes at least one notch therein for retaining the assembled display device in an assembled state.

19. A blank according to claim 17 wherein said fold lines for each of said two panels include first and second sets of oppositely extending fold lines extending from said point in opposite directions so as to inters opposite sides of the two panels, and first and second further fold lines extending from said point to an edge of said second end.

20. A blank according to claim 17 wherein said first ends of said two panels are of a shape of a ball used in a sport and the remaining panel includes a depiction of a player of the sport.

* * * * *